US007927437B2

(12) United States Patent
Gangopadhyay et al.

(10) Patent No.: US 7,927,437 B2
(45) Date of Patent: Apr. 19, 2011

(54) ORDERED NANOENERGETIC COMPOSITES AND SYNTHESIS METHOD

(75) Inventors: Shubhra Gangopadhyay, Columbia, MO (US); Rajesh Shende, Columbia, MO (US); Senthil Subramanian, San Diego, CA (US); Keshab Gangopadhyay, Columbia, MO (US); Shameem Hasan, Columbia, MO (US)

(73) Assignee: The Curators of the University of Missouri, Columbia, MO (US)

( * ) Notice: Subject to any disclaimer, the term of this patent is extended or adjusted under 35 U.S.C. 154(b) by 103 days.

(21) Appl. No.: 11/262,227

(22) Filed: Oct. 28, 2005

(65) Prior Publication Data

US 2007/0095445 A1 May 3, 2007

(51) Int. Cl.

| | |
|---|---|
| ***C06B 45/00*** | (2006.01) |
| ***C06B 33/00*** | (2006.01) |
| ***C06B 33/14*** | (2006.01) |
| ***C06B 31/28*** | (2006.01) |
| ***D03D 23/00*** | (2006.01) |
| ***D03D 43/00*** | (2006.01) |

(52) U.S. Cl. ..... 149/37; 149/2; 149/41; 149/46; 149/108.2; 149/109.4

(58) Field of Classification Search ..... 149/37, 149/2, 41, 46, 108.2, 109.4
See application file for complete search history.

(56) References Cited

U.S. PATENT DOCUMENTS

| | | | |
|---|---|---|---|
| 5,517,802 | A | 5/1996 | Weder |
| 6,199,484 | B1 | 3/2001 | Martinez-Tovar et |
| 6,298,784 | B1 | 10/2001 | Knowlton |
| 6,517,802 | B1 | 2/2003 | Xiao et al. |
| 6,539,869 | B2 | 4/2003 | Knowlton |
| 6,712,917 | B2 | 3/2004 | Gash et al. |
| 6,733,828 | B2 | 5/2004 | Chao et al. |
| 6,740,403 | B2 | 5/2004 | Gogotsi et al. |
| 6,818,081 | B2 | 11/2004 | Gash et al. |
| 6,818,344 | B2 | 11/2004 | Daoud |
| 6,923,946 | B2 | 8/2005 | Geohegan et al. |

(Continued)

FOREIGN PATENT DOCUMENTS

| | | |
|---|---|---|
| WO | WO2007/053397 | 5/2007 |

(Continued)

OTHER PUBLICATIONS

Pantoya, Michelle L. et al., "Combustion Behavior of Highly Energetic Thermites: Nano versus Micron Composites", *Propellants, Explosives, Pyrotechnics* 30 (2005), No. 1, pp. 53-62.

(Continued)

*Primary Examiner* — Jerry Lorengo
*Assistant Examiner* — James E McDonough
(74) *Attorney, Agent, or Firm* — Greer, Burns & Crain Ltd.

(57) ABSTRACT

A structured, self-assembled nanoenergetic material is disclosed that includes a nanostructure comprising at least one of the group consisting of a fuel and an oxidizer and a plurality of substantially spherical nanoparticles comprising at least the other of the group consisting of a fuel and an oxidizer. The spherical particles are arranged around the exterior surface area of said nanorod. This structured particle assures that the oxidizer and the fuel have a high interfacial surface area between them. Preferably, the nanostructure is at least one of a nanorod, nanowire and a nanowell, and the second shaped nanoparticle is a nanosphere.

21 Claims, 4 Drawing Sheets

U.S. PATENT DOCUMENTS

| | | | | |
|---|---|---|---|---|
| 6,962,634 | B2 | 11/2005 | Nielson | |
| 6,986,819 | B2 | 1/2006 | Tillotson et al. | |
| 7,025,840 | B1 * | 4/2006 | Adams | 149/108.2 |
| 7,192,649 | B1 * | 3/2007 | Jouet et al. | 428/457 |
| 2003/0096897 | A1 | 5/2003 | Nielson et al. | |
| 2003/0108683 | A1 | 6/2003 | Wu | |
| 2003/0145924 | A1 | 8/2003 | Carter, Jr. | |
| 2004/0005723 | A1 | 1/2004 | Empedocles et al. | |
| 2004/0056458 | A1 * | 3/2004 | Daoud | 280/736 |
| 2004/0203071 | A1 | 10/2004 | Chase et al. | |
| 2005/0189053 | A1 * | 9/2005 | Pile et al. | 149/108.6 |
| 2005/0216075 | A1 | 9/2005 | Wang et al. | |
| 2006/0236887 | A1 | 10/2006 | Childs et al. | |
| 2007/0095445 | A1 | 5/2007 | Gangopadhyay et al. | |
| 2007/0099335 | A1 | 5/2007 | Gangopadhyay et al. | |

FOREIGN PATENT DOCUMENTS

| | | |
|---|---|---|
| WO | WO2007/053543 | 5/2007 |
| WO | WO2007/099335 | 9/2007 |
| WO | WO2008/045101 | 4/2008 |
| WO | WO2008/048275 | 4/2008 |

OTHER PUBLICATIONS

Rama Venkatasubramanian, Edward Siivola, Thomas Colpitts & Brooks O'Quinn "Thin-film thermoelectric devices with high room-temperature figures of merit" Nature vol. 413, 2001, 597-602.

C. Greaves, "The direct conversion of heat into electricity Thermoelectric conversion and thermionic conversion" Physics Education, 1968, vol. 3 Printed in Great Britain, 330-337.

P.L. Hagelstein, Y. Kucherov, "Enhancement of Thermal to Electrical Energy Conversion with Thermal Diodes", Mat Res. Soc. Symp. Proc. vol. 691, 2002 Materials Research Society. G8.37.1-G837.6.

P.L. Hagelstein, Y. Kucherov, "Enhanced figure of merit in thermal to electrical energy conversion using diode structures", Appl. Phys. Lett. vol. 81, 2002, 559-561.

Gavens, A.J., Heerden, D.V., Mann A.B., Reiss, M.E., Weihs, T.P., "Effect of intermixing on self propagating exothermic reactions in Al/Ni nanolaminate foils", Journal of Applied Physics, 87(3) (2000) 1255-1263.

Technical Discussion in website http://www.risi-usa.com, 2000.

Deeds, M., Sandborn P., Swaminathan R., "Packaging of MEMS based safety and arming device", IEEE Proceedings of the intersociety conference on thermal phenomena, 2000, pp. 107-112.

Paul Redner, Steven Nicolich, Shybhra Gangopadhyay and Rajesh Shende, "The Development of Energetic Nanocomposites for the Warfighter", Particle Technology Forum, The 2005 Annual Meeting (Cincinnati, OH), Nov. 3, 2005.

Takayama, K., Saito, T. "Shock Wave/Geophysical and Medical Applications", Annual Review of Fluid Mechanics, 36 (2004) 347-49.

Malynych, Luzinow I., Chumanov G. "Poly (vinyl pyridine) as a universal surface modifier for immobilization of nanoparticles", J. Phys. Chem. B 106 (2002), 1280-85.

Stewart D.S., "Miniaturization of explosive technology and microdetonics", XCIICTAM, Aug. 15-21, 2004, Warsaw, Poland.

Bowden, F.P. And Yoffe, A.D., "Initiation and growth of explosions in liquids and solids", Cambridge University press, Cambridge, 1952.

Sheffield, S.A., Gustaven, R.L., Alcon, R.R., Graham, R.A. and Anderson, M.U., "Particle velocity and stress measurements in low density HMX," High pressure Science and Technology (1994) 1377-80.

Stephen D. Senturia, "Microsystem Design", Kluwer Academic Publishers, Boston/Dordrecht /London, 2001.

H.M. Mott-Smith, Irving Langmuir, "The theory of collectors in gaseous discharges", Physical Review, Oct. 1926, V. 28, 727-763.

Kaili Zhang, Chou, S.K.; Ang, S.S., "MEMS-based solid propellant microthruster design, simulation, fabrication, and testing", Journal of Microelectromechanical Systems, vol. 13, Issue: 2, Apr. 2004, pp. 165-175.

A.G. Merzhanov, "The Chemistry of Self-Propagating High Temperature Synthesis," J. Mater. Chem. 14 (2004) 1779-1786.

Merzhanov, A.G. 1990. Combustion and Plasma Synthesis of High Temperature Materials, edited by Munir, Z.A. and Holt, J.B. New York:VCH.

Munir, Z.A. and Anselmi-Tamburini "Self-Propagating Exothermic Reactions: The Synthesis of High-Temperature Materials by Compustion" (1989) 277-365.

Moore, J.J. and Feng H.J. "Combustion Synthesis of Advanced Materials: Part I. Reaction Paramters" Prog. Mater. Sci. 39 (1995) 243-273.

Moore, J.J. and Feng H.J. "Exothermic Reaction Synthesis", 295-311. Syntheis/Processing of Lightweight Metallic Materials Edited by F.H. Froes, C. Suryanarayana, and C.M. Ward—Close the Minerals, Metals & Materials Society, 1995.

S.A. Davis, S.L. Burkkett, N.H. Mendeison and S. Mann, "Bacterial templating of ordered macrostructures in silica and silica-surfactant mesophases", Nature, 1997, 385, 420-423.

H.-P. Lin, S. Cheng and C.-Y. Mou, "Mesoporous Molecular Sieves MCM-41 with a Hollow Tubular Morphology", 10, 1998, 581-589.

X. Yang, S. Chen, S. Zhao, D. Li, and H. Houyma. "Synthesis of copper nanorods using electrochemical methods" J Serb. Chem. Soc. 68 (11) (2003) 843-847.

Y.Y. Fu, R.M. Wang, J. Xu, J. Chen, Y. Yan, A.V. Narlikar, H. Zhang, "Synthesis of Large Arrays of Aligned $\alpha$-$Fe_2O_3$ Nanowires", Chemical Physics Letters 379 (2003) 373-379.

Serhiy Malynych, Igor Luzinov, and George Chumanov, "Poly(Vinyl Pyridine) as a universal surface modifier for immobilization of nanoparticles" J. Phys. Chem. B 2002 106, 1280-1285.

Newkome, G.R.; Woosley, B.D.; He, E.; Moorefield, C.D.; Guter, R.; Baker, G.R.; Escamilla, G.H.; Merrill, J. ; Luftmann, H. "Supramolecular chemistry of flexible, dendritic-based structures employing molecular recognition" Chem. Commun. 1996, 2737-2738.

Newkome, G.R.; He, E.; Moorefield, C.N., "Suprasupermolecules with Novel Properties:Metallodendrimers" Chem. Rev. 99 (1999) 1689-1746.

Narayan K. Raman, Mark T. Anderson, and C. Jeffrey Brinker, "Template-Based Approaches to the Preparation of Amorphous, Nanoporous Silicas" Chem. Mater. 8 (1996) 1682-1701.

T. Kang, Y. Park, K. Choi, J.S. Lee, and J. Yi, "Ordered mesorporous silica (SBA-15) dramatized with imidazole-containing functionalities as a selective absorbent of precious metal ions", J. Mater. Chem., 14 (2004) 1043-49.

Clapsaddle, B.J.; A.E. Gash, K.B. Plantier, M.L. Pantoya, J.H. Satcher, JR., R.L. Simpson, "Synthesis and Characterization of Mixed Metal Oxide Nanocomposite Energetic Materials", *Proceedings of the* 31st *international Pyrotechnics Seminar*, May 12, 2004.

Gash et al., "Nanostructured Energetic Materials with Sol-Gel Methods" Materials Research Society, Fall 2003 Meeting, Nov. 26, 2003.

Granier, John J; Michelle L. Pantoya, "Laser Ignition of Nanocomposite Thermites", *Combustion and Flame*, vol. 138, 2004, pp. 373-383.

Kim, Soo H.; Michael R. Zachariah, "Enhancing the Rate of Energy Release from NanoEnergetic Materials by Electrostatically Enhanced Assembly", *Advanced Materials*, vol. 16, No. 20, Oct. 18, 2004, pp. 1821-1825.

Kliche, G.; et al., "Far-infrared spectroscopic investigations on CuO", *Physcial Review*, vol. 42, No. 16, Dec. 1, 1990, pp. 10060-10066.

C.Y. Mou et al., "Control of Morphology in Synthesizing Mesoporous Silica", *Pure Appl. Chem.* vol. 72, Nos. 1-2, 2000, pp. 137-146.

Music, S.; S. Krehula, S. Popovic, "Thermal Decomposition of $\beta$-FeOOH", *Materials Letters*, vol. 58, 2004, pp. 444-448.

Newkome, G.R.;et al., "Suprasupermoleculars with Novel Properties: Metallodendrimers", *Chem. Rev.*, vol. 99, 1999, pp. 1689-1746.

Osborne, Dustin Travis, "The Effects of Fuel Particle Size on the Reaction of A1/Teflon Mixtures", Thesis in Mechanical Engineering, May 2006, pp. 1-47.

Prakash, Anand et al., Synthesis and Reactivity of a Super-Reactive Metastable Intermolecular Composite Formulation of $A1/KM_nO_4$, *Advanced Materials*, vol. 17, No. 7, 2005, pp. 900-903.

Tripkovic, Amalija V. et al., "Comparison of formic acid oxidation at supported Pt catalyst and at low-index Pt single crystal electrodes insulfuric acid solution", *J. Serb. Chem. Soc.*, vol. 68, No. 11, 2003, pp. 849-857.

Vayssieres, Lionel; Corrine Chaneac, Elisabeth Tronc, Jean Pierre Jolivet, "Size Tailoring of Magnetite Particles Formed by Aqueous Precipitation: An Example of Thermodynamic Stability of Nanometric Oxide Particles", *Journal of Colloid and Interface Science*, vol. 205, 1998, pp. 205-212.

Vayssieres, Lionel; Anders Hagfeldt, Sten Eric Lindquist, "Purpose-Built Metal Oxide Nanomaterials. The Emergence of a New Generation of Smart Materials", *Pure Appl. Chem.*, vol. 72, No. 1, 2000, pp. 47-52.

Vayssieres, Lionel; et al., "Controlled Aqueous Chemical Growth of Oriented Three-Dimensional Crystalline Nanorod Arrays: Application to Iron (III) Oxides", *Chemistry of Materials*, vol. 13, No. 2, Feb. 2001, pp. 233-235.

Vayssieres, Lionel;, et al., "Purpose-Built Ansiotropic Metal Oxide Material: 3D Highly Oriented Microrod Array of ZnO", *J. Phys. Chem.*, B vol. 105, No. 17, 2001, pp. 3350-3352.

Vayssieres, Lionel; "Aqueous purpose-built nanostructured metal oxide thin films", *Int. J. of Material & Product Technology*, vol. 18, Nos. 4/5/6, 2003, pp. 313-337.

J.J. Moore et al., "Exothermic reaction Synthesis", *Synthesis/Processing of Lightweight Metallic Mateials*, 1995, pp. 295-311.

Apperson, S., et. al., "Generation of fast propagating combustion and shock waves with copper oxide/aluminum nanothermite composites", *Applied Physics Letters*, 91, 243109, 2007.

Baer, M.R., et. al., "Micromechanical Modeling of Heterogeneous Energetic Materials", *Eleventh Symposium (International) on Detonation*, Aug. 1998.

Beloni, Ervin, et. al., "Development of Insensitive High Energy Density Nanomaterials", *AIAA Regional I-NE Student Conference*, Cambridge. MA, Apr. 2007.

Bowden, F.P., et. al., "Initiation and Growth of Explosion in Liquids And Solids", *Cambridge at the University Press*, 1952.

Brousseau, Patrick et. al., "Nanometric Aluminum in Explosives", *Propellants, Explosives, Pyrotechnics*, 27, p. 300-306, 2002.

Clapsaddle, B.J., et. al., "Synthesis and Characterization of Mixed Metal Oxide Nanocomposite Energetic Materials", *International Pyrotechnics Seminar*, Fort Collins, CO, Jul. 12-16, 2004.

Davis, S.A. ; S.L. Burkkett, N.H. Mendeison and S. Mann, "Bacterial templating of ordered macrostructures in silica and silica-surfactant mesophases", Nature, 1997, 385, 420-423.

Fu, Y.Y.; R.M, Wang, J. Xu, J. Chen, V. Van, A.V. Narlikar, H. Zhang, "Synthesis of Large Arrays of Aligned $\alpha$-$Fe_2O_3$ Nanowires", Chemical Physics Letters 379 (2003) 373-379.

Gash, A., et. al., "Nanostructured Energetic Materials with Sol-Gel Methods", *Materials Research Society Fall 2003 Meeting*, Boston, MA Dec. 1-5, 2003.

Greaves, C., "The direct conversion of heat into electricity Thermoelectric conversion and thermionic conversion" Physics Education, 1968, vol. 3 Printed in Great Britain, 330-337.

Hagelstein, P.L.; Y. Kucherov. "Enhancement of Thermal to Electrical Energy Conversion with Thermal Diodes", Mat Res. Soc. Symp. Proc. vol. 691, 2002 Materials Research Society. G8.37.1-G837.6.

Hagelstein, P.L.; Y. Kucherov, "Enhanced figure of merit in thermal to electrical energy conversion using diode structures", Appl. Phys. Lett. vol. 81, 2002, 559-561.

Jones, David E.G., et. al., "Hazard Characterization of Aluminum Nanopowder Compositions", *Propellants, Explosives, Pyrotechnics* 28, No. 3, 2003.

Kang, T.; Y. Park, K. Choi, J.S. Lee, and J. Yi, "Ordered mesorporous silica (SBA-15) dramatized with imidazole-containing functionalities as a selective absorbent of precious metal ions", J. Mater. Chem., 14 (2004) 1043-49.

Kim, Soo H., et. al., "Enhancing the Rate of Energy Release from NanoEnergetic Materials by Electrostatically Enhanced Assembly", *Adv. Mater.*, 16, No. 20, Oct. 18, 2004.

Kliche, G., et. al., "Far-infrared spectroscopic investigations on CuO", *Physical Review B*, vol. 42, No. 16, Dec. 1, 1990.

Kwok, Queenie S.M. et. al., "Characterization of Aluminum Nanopowder Compositions", *Propellants, Explosives, Pyrotechnics* 27, p. 229-240, 2002.

Laritchev, Mikhail et. al., "New Reactive Surface Coatings for Al Metal Nanoparticles", *36th Annual Conference of ICT & 32nd International Pyrotechnics Seminar*, Jun. 28-Jul. 1, 2005.

Lessard, P., et, al., "Burn Rate Studies of Composite Propellants Containing Ultra-Fine Metals", *Energetic Materials*, 2001.

Lewis Jr., David H., et. al., "Digital MicroPropulsion", *Twelfth IEEE International Conference on Micro Electro Mechanical Systems*, 1999.

Lin, H.-P.: S. Cheng and C.-Y. Mou, "Mesoporous Molecular Sieves MCM-41 with a Hollow Tubular Morphology", vol. 10, 1998, pp. 581-589.

Malynych, Serhiy; Igor Luzinov, George Chumanov, Poly (Vinyl Pyridine) as a Universal Surface Modifier for Immobilization of Nanoparticles, *J. Phys. Chem.B*, vol. 106, 2002, pp. 1280-1285.

Mehendale, Bhushan Rajesh Shende, Senthil, Subramanian, Shubhra Gangopadhyay, "Nanoenergetic Composite of Mesoporous Iron Oxide and Aluminum nanoparticles", *Journal of Energetic Materials*, vol. 24, 2006, p. 341-360.

Merzhanov, A.G. 1990. "Self-Propagating High-Temperature Synthesis: Twenty Years of Search and Findings", 1990; Combustion and Plasma Synthesis of High Temperature Materials, edited by Munir, Z.A. and Holt, J.B. New York:VCH, J.B. New York:VCH.

Merzhanov, Alexander G., "The chemistry of self-propagating high-temperature synthesis", *Journal of Materials Chemistry*, 14, p. 1779-1786, 2004.

Moore, J.J., et al., "Exothermic Reaction Synthesis of Composite Materials", *Synthesis/processing of lightweight metallic materials; proceedings of a symposium held during the TMS annual meeting in Las Vegas*, Feb. 1995, p. 295-310.

Mott-Smith, H.M.; Irving Langmuir, "The theory of collectors in gaseous discharges", Physical Review, Oct. 1926, V. 28, 727-763.

Munir, Zuhair A., et. al, "Self-Propagating Exothermic Reactions: The Synthesis of High-Temperature Materials By Combustion", *Materials Science Reports*, 3, p. 277-365, 1989.

Newkome G,R.; Woosley, B.D.; He E,; Moorefield, C.D.; Guter, R.; Baker, G.R.; Escamilla, G.H.; Merrill, J.; Luftmann, H. "Supramolecular chemistry of flexible, dendritic-based structures employing molecular recognition" Chem. Commun. 1996, 2737-2738.

Osbourne, Dustin T., "The Effects of Fuel Particle Size on the Reaction of A1/Teflon Mixtures", *Submitted to the Graduate Faculty of Texas Tech University*, May 2006.

Prakash, Anand et al., Synthesis and Reactivity of a Super-Reactive Metastable Intermolecular Composite Formulation of $A1/KM_nO_4$ . *Advanced Materials*, vol. 17, No. 7, Apr. 14, 2005, pp. 900-903.

Raman, Narayan K., et. al., "Template-Based Approaches to the Preparation of Amporphus, Nanoporous Silicas", *American Chemical Society*, 1996.

Redner, Paul, et. al., "The Development of Energetic Nanocomposites for the Warfighter", *Nano-Engerectic Materials 2005 Annual Meeting*, Cleveland, OH, 2005.

Senturia, Stephen D., "Microsystem Design", *Kluwer Academic Publishers*, Boston/Dordrecth/London, 2001.

Sheffield, S. A., "Particle Velocity and Stress Measurements in Low Density HMX", *American Institute of Physics*, 1994.

Shende, Rajesh et al., "Nanoenergetic Composites of CuO Nanorods, Nanowires, and Al-Nanoparticles", *Propellants, Explosvies, Pyrotechnics*, vol. 33, Issue 2, p. 122-130, Apr. 2008—published online Mar. 13, 2008.

Stewart, D. Scott, "Miniaturization of Explosive Technology and Microdetonics", *XXI ICTAM*, Aug. 15-24, 2004, Warsaw, Poland.

Trott W.M., Erricson, K.L., Ultra highspeed studies of shock phenomenon in a miniaturized system—A preliminary evaluation, Sandia National Laboratories Release, Albuquerque, New Mexico 87185, Sep. 1997.

Venkatasubramanian, Rama, et. al., "Thin-film thermoelectric devices with high room-temperature figures of merit", *Nature*, vol. 413, Oct. 2001.
Yang, X.; S. Chen. S. Zhao, D. Li, and H. Houyma. "Synthesis of copper nanorods using electrochemical methods" J Serb. Chem, Soc. 68 (11) (2003) 843-847.
Zhang, Kaili, et. al., "MEMS-Based Solid Propellant Microthruster Design, Simulation, Fabrication and Testing", *Journal of Microeletromechanical Systems*, vol. 13, No. 2, Apr. 2004.

* cited by examiner

ORDERED NANOENERGETIC COMPOSITES AND SYNTHESIS METHOD

STATEMENT OF GOVERNMENT INTEREST

This application was supported by the Government assistance under U.S. Army Grant No. DAAE30-02-C-1132. The Government has certain rights in this invention.

CROSS REFERENCE TO RELATED APPLICATION

This application is related to U.S. Ser. No. 11/261,831, entitled, "On-Chip Igniter and Method of Manufacture," filed concurrently herewith and herein incorporated by reference.

FIELD OF THE INVENTION

This invention relates the use of nanotechnology to make metastable intermolecular composites ("MICs") with tunable combustion characteristics. More specifically, nanoparticles of fuel and oxidizer are shaped and self-assembled to create ordered nanoenergetic composites to achieve higher burn rates resulting in creation of shock waves.

BACKGROUND OF THE INVENTION

Energetic materials are those that rapidly convert chemical enthalpy to thermal enthalpy. These materials are commonly known as explosives, propulsion fuels and pyrotechnics. Thermite is a well-known subgroup of pyrotechnics. It is a combination of a fuel and an oxidizer that combusts in a self-propagating reaction producing temperatures of several thousand degrees. Either alone or in combination with other high energy materials, thermites are used for various applications that include military, mining, demolition, precision cutting, explosive welding, surface treatment and hardening of materials, pulse power applications, sintering-aid, biomedical applications, microaerospace and satellite platforms. In solid form, thermite is often a first metal and the oxide of a second metal, such as aluminum and iron oxide.

Self-propagating high temperature synthesis ("SHS") relates to the synthesis of compounds that combust in a wave of chemical reaction that propagates over the reactants, producing a layer-by-layer heat transfer. Properties such as burn rate, reaction temperature and energy release are very important. In powder-based SHS materials, solid fuel and oxidizer are ground into fine micron-sized particles and combined. In these systems, reactions depend strongly on the interfacial surface area between the fuel and the oxidizer which is affected by the size, impurity level and packing density of the constituent powders. Since the particle size predominates in determining particle surface area, use of smaller particles is desirable to increase the burn rate of the SHS and metastable intermolecular composites ("MIC") material.

Even if smaller particle size is achieved, mere mixing of the fuel and the oxidizer is not sufficient to guarantee an increase in the interfacial surface area. Mixing of the powders results in a random particle distribution. In such a distribution, many of the fuel particles will be surrounded by other fuel particles. There will be many places where the oxidizer has little contact with fuel particles. To significantly increase the interfacial surface area, the particles must be specifically arranged so that a large number of fuel particles contact oxidizer particles and vice versa.

The propagation rate or energy release rate is increased by homogeneous distribution of the oxidizer and the fuel in the composite. This provides high interfacial area for fuel and oxidizer as well as reduced interfacial diffusional resistance. Thus on initiating a thermite reaction, the combustion wavefront assumes maximum hot spot density resulting in a high rate of energy release. In other words, such materials would show a higher burn rate or flame propagation rates. To have homogeneous distribution of the oxidizer and fuel, a self-assembly process can be very useful. Although a similar process has been demonstrated in several different research areas, preparation of ordered nanoenergetic structures has not been shown. In the self-assembly process, fuel particles are arranged in an orderly manner around oxidizer or vice versa.

Although solid spherical nanoparticles of both the oxidizer and fuel can be assembled to create a nanoenergetic composite, the surface area in spherical nanoparticles is generally smaller than cylindrical shaped nanoparticles. In cylindrical oxidizer nanoparticles such as nanorods, it is possible to assemble a greater number of fuel nanoparticles than spherical oxidizer nanoparticles. Such composites result in higher energy density than spherical particle assembly and releases energy through conduction mechanism. In the case of porous oxidizer, such as a sol-gel oxidizer, convection generally improves the performance. Recent inventions by others provide a technique of mixing of fuel nanoparticles during gelation of oxidizers, but in these reports, the microstructures do not show homogenous distribution of fuel nanoparticles inside porous oxidizers.

Manufacture of ordered nanoparticles is a technique known for the preparation of catalysts. This technique allows two different types of particles to be arranged into nanoparticles in an orderly fashion.

SUMMARY OF THE INVENTION

These and other needs in the art are met or exceeded by the present invention which generates structured particles having a high interfacial surface area between a fuel and an oxidizer. More specifically, this invention relates to a MIC or SHS material that is assembled for good oxidizer-fuel contact.

In a first embodiment of the invention, a structured, self-propagating high temperature synthesis material that includes a nanostructure comprising at least one of the group consisting of a fuel and an oxidizer and a plurality of substantially spherical nanoparticles comprising at least the other of the group consisting of a fuel and an oxidizer. The spherical particles are arranged around the exterior surface area of said nanorod. This structured particle assures that the oxidizer and the fuel have a high interfacial surface area between them. Preferably, the nanostructure is at least one of a nanorod and a nanowell, and the second shaped nanoparticle is a nanosphere.

Production of fuel and oxidizer particles in the nanopartical size range increases the potential for high interfacial surface area. Smaller particle size increases the amount of available surface area. As greater surface area is generated, more it is likely to interface with the surface of different particles, even in random mixtures of particles. Thus, reduction of particle size has the potential to increase the interfacial surface area between the fuel and the oxidizer. Creating a nanorod in place of a nanosphere for at least one particle type also leads to an increase in surface area of about 40%.

Structuring of the particles further adds to increases in the interfacial surface area. Placement of nanospheres of one material around nanorods of the other material assures at least some interfacial contact with the other material for each particle. This structure results in additional increases in interfacial surface area, leading to faster burn rates and increases in energy expended.

DETAILED DESCRIPTION OF THE DRAWINGS

DETAILED DESCRIPTION OF THE INVENTION

There is, therefore, a need in the art for a composite material having a high interfacial surface area. There is also a need for a combustible material having a burn rate that exceeds the speed of sound in that material.

Figure 1:
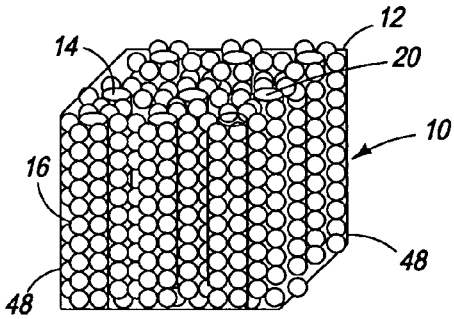
FIG. 1 shows a schematic diagram of a nanoenergetic material having a nanorod made of oxidizer covered fuel-containing nanospheres.

Turning to FIG. 1, a preferred embodiment is shown wherein a nanoenergetic particle, generally designated 10, includes a nanostructure 12 of oxidizer 14 material self-assembled with a fuel 16 in the shape of nanoparticles 18. The nanoenergetic particle 10 is preferably a thermite composition, utilizing a metal fuel 16 and an oxidizer 14 for the metal. Other preferred nanoenergetic particles include metastable intermolecular composites and SHS composites. The efficacy of the nanoenergetic particle 10 increases as the purity of the components increases, so the preferred oxidizer 14 and fuel 16 are both relatively high purity. In the discussion that follows, the fuel 16 nanoparticle 18 is described as being shaped into a nanosphere and the oxidizer 14 is shaped into a nanostructure 12, such as a nanorod 20, nanowire (not shown) or nanowell 24. These are preferred embodiments of the invention, but are not intended to be limiting in any way. Use of the fuel 16 as a nanorod 20 or nanowell 24 and spherical oxidizer 14 particles is also contemplated. The fuel 16 and the oxidizer 14 are suitably formed into any shapes that are complimentary to each other, and that increase the interfacial surface area compared to a random particle distribution.

Figure 2:
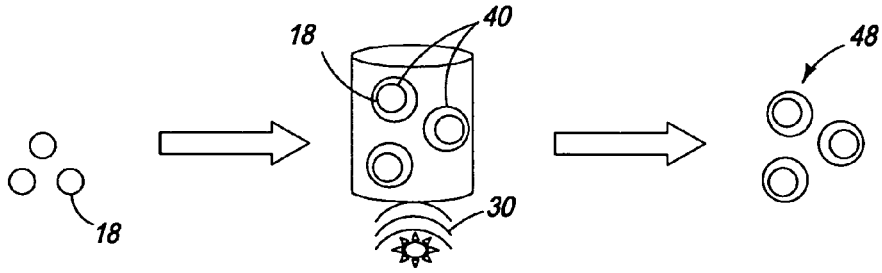
FIG. 2 shows a schematic diagram of the process of coating a nanosphere with a molecular linker.

A wide variety of fuels 16 are useful in this invention. Where the nanoenergetic material 10 is a thermite, the preferred fuel 16 is a metal. Preferred metals include aluminum, boron, beryllium, hafnium, lanthanum, lithium, magnesium, neodymium, tantalum, thorium, titanium, yttrium and zirconium. The use of two or more metals, either physically mixed or alloyed, is contemplated. Referring to FIG. 2, the fuel 16 is formed into a shape, such as a nanosphere 18, that provides a homogeneous dispersion and a high surface area compared to the fuel volume. Sonication 26 is the preferred method for shaping the fuel 16 particles. The fuel 16 is placed 28 in a solvent such as 2-propanol and positioned within the sonic field 30. When activated, the sound waves 30 disperse the fuel 16, creating extremely small particles that are often substantially monoparticles, comprising few single atoms or molecules of fuel. The high degree of dispersion creates an extremely high fuel 16 surface area. Other shapes, or larger particles, are useful in applications where the extremely fast burn rate is not required.

The oxidizer 14 should be selected to have a high exothermic heat of reaction with the chosen fuel 16. The fuel 16 and the oxidizer 14 are chosen to assure that a self-propagating reaction takes place. As long as the fuel 16 has a higher free energy for oxide formation than the oxidizer 14, an exothermic replacement reaction will spontaneously occur. Preferred oxidizers 14 include copper oxide (CuO or $Cu_2O$), silver oxide (AgO or $Ag_2O$), boron oxide ($B_2O_3$) bismuth oxide ($Bi_2O_3$), Cobalt oxide (CoO), chromium oxide ($CrO_3$), iron oxide ($Fe_2O_3$) mercuric oxide (HgO), iodine oxide ($I_2O_5$), manganese oxide ($MnO_2$), molybdenum oxide ($MoO_3$), niobium oxide ($Nb_2O_5$), nickel oxide (NiO or $Ni_2O_3$), lead oxide (PbO or $PbO_2$), palladium oxide (PdO), silicone oxide ($SiO_2$), tin oxide (SnO or $SnO_2$), tantalum oxide ($Ta_2O_5$), titanium dioxide ($TiO_2$), uranium oxide ($U_3O_8$), vanadium oxide ($V_2O_5$) and tungsten oxide ($WO_3$).

Optimally, the amounts of fuel 16 and oxidizer 14 present in the thermite are in a stoichiometric ratio for combustion of the fuel with the oxidizer. Preferred equivalence ratio, $$\Phi = \frac{(F/A)_{actual}}{(F/A)_{stoichiometric}}$$

should be between 1.4 to 1.8.

Figure 3:
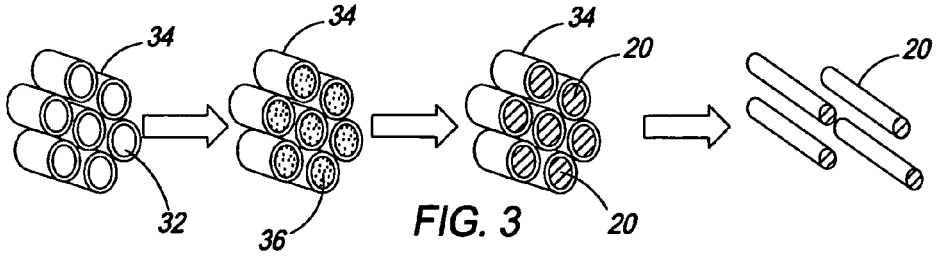
FIG. 3 shows a schematic diagram of nanorod formation.

Preferably, the oxidizer 14 is shaped into a nanorod 20, nanowire or a nanowell 24. In a preferred embodiment, the oxidizer 14 particle is shaped by providing 31 a polymeric surfactant having a micelle 32 forming of a crystalline structure inside the micelle 32 of a surfactant 34. One preferred method of creating the crystals is by filling the micelle 32 with oxidizer precursors 36 that react to form the oxidizer 14 in situ. Synthesis of copper oxide nanorods 20, as shown in FIG. 3 for example, includes grinding copper chloride dihydrate and sodium hydroxide into fine powders, then added to a polyethylene glycol, such as PEG 400 (Alfa Aesar, Ward Hill, Mass.).

The nanorods 20 are preferably synthesized inside and take the shape of the micelles 32 of the polymeric surfactant 34. Nanowires are long, thin nanorods 20. Diblock copolymers are known as surfactants 34 having micelles 32. Polyethylene glycol, such as PEG 400 is preferred for this task. PEG 400 produces nanorods 20 of substantially uniform size. As the molecular weight of the polyethylene glycol increases, the diameter of the nanorod 20 changes, which leads to the nanowire-type structure. For example, PEG 200 produces nanospheres 18, PEG 400 produces nanorods 20, and PEG 2000 produces nanowires. The surfactant 34 is selected by the size of its micelles 32 to produce nanorods 20 or nanowires of a particular diameter. Addition of water to the surfactant yields a mixture of nanorods 20 of varying length and having a longer average length.

In a preferred embodiment, the oxidizer 14 is formed by depositing 33 the reaction product of the oxidizer precursors 36 in situ within the micelles 32 of the surfactant 34 to form the nanorods 20. In a preferred embodiment, copper chloride dihydrate and sodium hydroxide are combined to produce 35 copper oxide within the micelles of PEG 400. Other suitable precursors include copper nitrate, copper carbonate, copper acetate, copper sulfate, copper hydroxide, and copper ethoxide. The ratio of copper chloride dihydrate to sodium hydroxide is from about 1.66 to about 2.1. The copper chloride dihydrate, sodium hydroxide and PEG 400 are pulverized with a mortar and pestle for 30 minutes. Preferred grinding times are from about 10 to about 45 minutes. Other methods of combining these ingredients include stirring, mixing, milling, and attrition. The copper chloride dihydrate and sodium hydroxide react to form copper oxide 14 in the PEG based template. Upon washing 39 with one or more solvents, such as water and ethanol, the polyethylene glycol is removed, yielding free-standing copper hydroxide and oxide nanorods 20. Calcination at a suitable temperature produces the finished nanorods 20 made up of the copper oxide oxidizer 14. For copper oxide, calcinations at 450° C. for 4 hours is sufficient.

At least one of the oxidizer 14 and the fuel 16 is coated 41 with a molecular linking substance 40 that attracts the particles to each other. Preferably the molecular linker 40 is a polymer having two different binding sites, each of which chemically or physically bonds with either the fuel 16 or the oxidizer 14. Preferably, the binding sites are not random, but are spaced to closely fit the nanospheres 18 against the nanorods 20 for good interfacial surface area.

The presence of material other than fuel 16 and oxidizer 14 tends to slow the burn rate of the nanoenergetic material 10. Cross-linking or bonding of the molecular linker 40 with itself makes it difficult or impossible to remove excess polymer, thus reducing the burn rate. Thus, another preferred feature of the molecular linker 40 is that it does not bond with itself, allowing excess polymer to be removed until essentially a monolayer of molecular linker remains. Excess molecular linker 40 is preferably removed 43 by sonication of the particles after its application.

Suitable molecular linker polymers 40 include polyvinyl pyrrolidone, poly(4-vinyl pyridine), poly(2-vinyl pyridine), poly(ethylene imine), carboxylated poly(ethylene imine), cationic poly(ethylene glycol) grafted copolymers, polyaminde, polyether block amide, poly(acrylic acid), cross-linked polystyrene, poly(vinyl alcohol), poly(n-isopropylacrylamide), copolymer of n-acryloxysuccinimide, poly (acrylontrile), fluorinated polyacarylate, poly(acrylamide), polystyrene-poly(4-vinyl)pyridine and polyisoprene-poly(4-vinyl)pyridine. The use of the molecular linker 40 with binding sites is a good method for self-assembly, because each polymer molecule has numerous binding sites. Therefore, when a molecular linker is adsorbed on a surface it has many more binding sites for binding other nanoparticles. Poly(4-vinyl pyridine) and its analogues are attractive to create self-assembled structures. The pyridyl group in its neutral form has a lone pair of electrons which can be donated to form covalent bonds with metals, undergo hydrogen bonding with the polar species and interact with charged surfaces. The various ways in which molecular linker polymer can interact with surfaces makes it universal binding agent for nanostructural assemblies. The use of this polymer is not yet demonstrated to create self-assembled ordered structure of energetic material.

Metal nanoparticles, such as aluminum nanoparticles, are sonicated in alcohol for a time sufficient to achieve homogenous dispersion. The preferred alcohol is 2-propanol, however, the use of other solvents that allow dispersion of the fuel. The ratio of fuel 16 to solvent of about 0.0875 to 0.75 is preferred, though other ratios are useful for other applications.

Sonication is conducted with any type of sonication equipment 44. Preferably, for synthesis purposes a sonic bath (Cole Parmer Model 8839) is used. The output sound frequency used is in the range of about 50-60 Hz. Duration of the sonication treatment is any time sufficient to remove all of the molecular linker 40 except the layer that is bound to the fuel 16 or the oxidizer 14. Preferably, it is at least 3 hours, and is preferably from about 3 hours to about 16 hours. Centrifugation 47 is preferably combined with sonication to more rapidly remove the excess molecular linker 40.

The steps of sonication followed by centrifugation may be repeated several times to remove excess molecular linker polymer 40 from the fuel 16 or oxidizer 14 particles. The process is repeated as many times as needed. Polymer coated fuel particles, generally 48, result that have a very thin coating of polymer 40. Preferably the coating is so thin as to form essentially a polymer monolayer. As a result of this process, the resulting coated fuel particles 48 are preferably from about 50 to about 120 nanometers in diameter. Particle diameters of about 50 to about 80 nanometers are more preferred. Reduction of coated fuel particle 48 diameter below about 18 nanometers results in a particle that has a ratio of fuel 16 to polymer 14 that is too low to burn efficiently.

Self-assembly of the oxidizer 14 nanorods 20 and the coated fuel particles 48 preferably takes place by sonication. Oxidizer 14 nanorods 20 are added to a solvent for several hours. The preferred solvent is 2-propanol, but other solvents for sonication as listed above are also useful. Duration for the sonication treatment is preferably from about 3 hours to about 4 hours. The well-dispersed coated fuel particles 48 were then added 51 to the dispersion of the oxidizer 14 nanorods 20. An additional sonication step was carried out from about 3 hours to about 0.4 hours. While in the sonicator, the oxidizer 14 and the fuel 16 are thoroughly dispersed. To disperse the fuel 16 and oxidizer 14, a sonic wand with an output frequency of about 55 kHz is used. The time for sonication is about 9 minutes, but longer sonication times are used depending on the specific application. During the dispersion, the fuel particles coated with the molecular linker 48 are likely to encounter and bind 53 with an oxidizer 14 nanorod 20. Since the molecular linker 40 has bonding sites specific for the oxidizer 14, the oxidizer nanorods 20 will bind to the linker 40 on the coated fuel particle 48, holding them in a position to generate a product with a high interfacial surface area. The final solution is then dried to obtain the complete nanocomposite 10.

Oxidizer nanowires can also be synthesized and used to make nanoparticle composite 10. The nanowires were preferably formed by precipitation of the oxidizer 14 from a precipitate of two or more oxidizer precursors 36 from a solution that includes the surfactant 32. In one embodiment, copper oxide nanowires were synthesized using surfactant templating method. Preferably, polyethylene glycol was mixed with water (2.5:1.5) under continuous stirring to make an emulsion. About 0.5 g of copper chloride was dissolved in that emulsion. Another emulsion was prepared using same ratio of PEG and water and then 0.5 g of NaOH was added into it under continuous stirring. The emulsion with copper chloride oxidation precursor 36 is then mixed with the emulsion with NaOH oxidation precursor 36 and stirred slowly for several minutes. In the final solution, an excess amount of ethanol was added to form a grey precipitate. The grey precipitate was then sonicated for 3 hours then centrifuged at 3000 rpm for 10 minutes to collect precipitates. This cycle was repeated at least three times to remove the excess surfactant 32. The sample is then dried in air at 60° C. for four hours. The dried powder is then calcined at 450° C. for 4 hours to get crystalline copper oxide nanowire.

Figure 4:
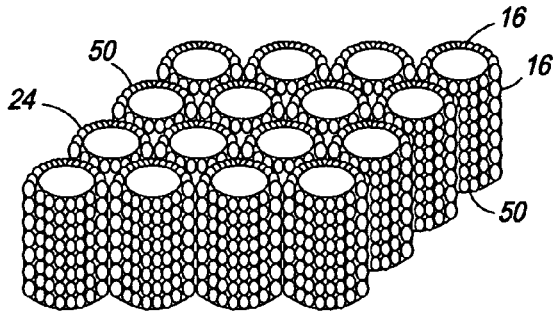
FIG. 4 shows a schematic diagram of a nanowell.

Turning to FIG. 4, as another alternative to making nanorods 20, the oxidizer 14 can be formed into nanowells 24 using the technique of templating assisted nucleation. Nanowells 24 are shaped to have holes or openings in the oxidizer 14 structures into which the fuel 16 particles are placed. In this technique, the nanowells 24 are formed 52 around the exterior of the micelles 32 of the polymeric surfactant 34. Growth of mesopores is controlled on a length of 1-1.5 microns leading to nanowell 24 structures. This process can be used for any metal, metal oxide and metal ligands. The size and shape of the nanowells 24 depends on the characteristic shape of the micelles 32 in the specific surfactant 34 selected. As with nanorods 20, the surfactant is removed 54 from the nanowell 24 prior to forming the nanoenergentic material 10.

Pluronic 123 (BASF, Mt. Olive, N.J.) is a preferred block co-polymer surfactant 34 for making nanowells 24. Preferably, the surfactant 34 is added to a solvent, such as ethylene glycol methyl ether (methoxyethanol), however, other solvents such as ethoxyethanol, methoxyethanol acetate can also be used. The concentration of the surfactant 34 is in the range of 1-60 wt % based on metal alkoxide. Higher concentrations are generally limited by the solubility, which can be improved if a mild heating (up to about 40° C.) with stirring is provided. To this block polymer 34 solution, copper ethoxide, in amounts of about 2-10% g/100 ml is added. Following this, a mild acid, such as 0.01-25 M acetic acid is added to generate a copper complex. This complex undergoes olation in the presence of water and hydrochloric acid.

The fuel 16 is preferably input to the nanowells by means of impregnation. Fuel particles coated with a monolayer of the molecular linker 48 are prepared as described above. The sonicated and centrifuged particles are then dispersed in methoxyethanol and the second reaction component to form the oxidizer. Fuel particles 16 are held within the nanowells 24 by the monolayer of molecular linker 40 present on the surface of the fuel.

Acetic acid and water were added to achieve the nanowell 24 gel structure. Following impregnation with the fuel 16, the gel was heat processed to drive off organic impurities and templating agents. Preferably, the heat treatment occurs at temperatures of about 200° C. to about 800° C. The duration of the heat treatment should be sufficient to drive off the unwanted components at the temperature selected. Pressure reduction also aids in driving off volatile components. During preparation of copper oxide oxidizer 14, the gels were heat treated for 24 hours at 200° C. under a vacuum. Dried gels were sonicated in n-hexane in presence of a surfactant and sonicated for few hours. After this, the gels were washed with ethanol and dried at 200° C. for 2 h to obtain free flowing porous gel particles.

In addition to oxidizer 14 and fuel 16 nanoparticles, explosive nanoparticles 50 are optionally added to some embodiments of the nanoenergetic materials 10. These explosive nanoparticles 50 can be added to any of the above nanoenergetic composites 10 to improve the performance in terms of higher pressures and detonation. In synthesizing explosive nanoparticles 50, a process is used similar to that described above with respect to formation of the fuel nanoparticles 18. An explosive material, such as ammonium nitrate, is formed into nanoparticles by dispersion in one or more solvents, then sonicated to obtain a homogeneous material. The solvents are removed by centrifugation and heating.

Stabilization of explosive nanoparticles 50 is performed by forming a core-shell structure with metal oxides. For example, a coating of copper oxide is formed on the ammonium nitrate nanoparticles 50. The process is suitable to produce the core-shell structure with several other metal oxides.

Figure 5:
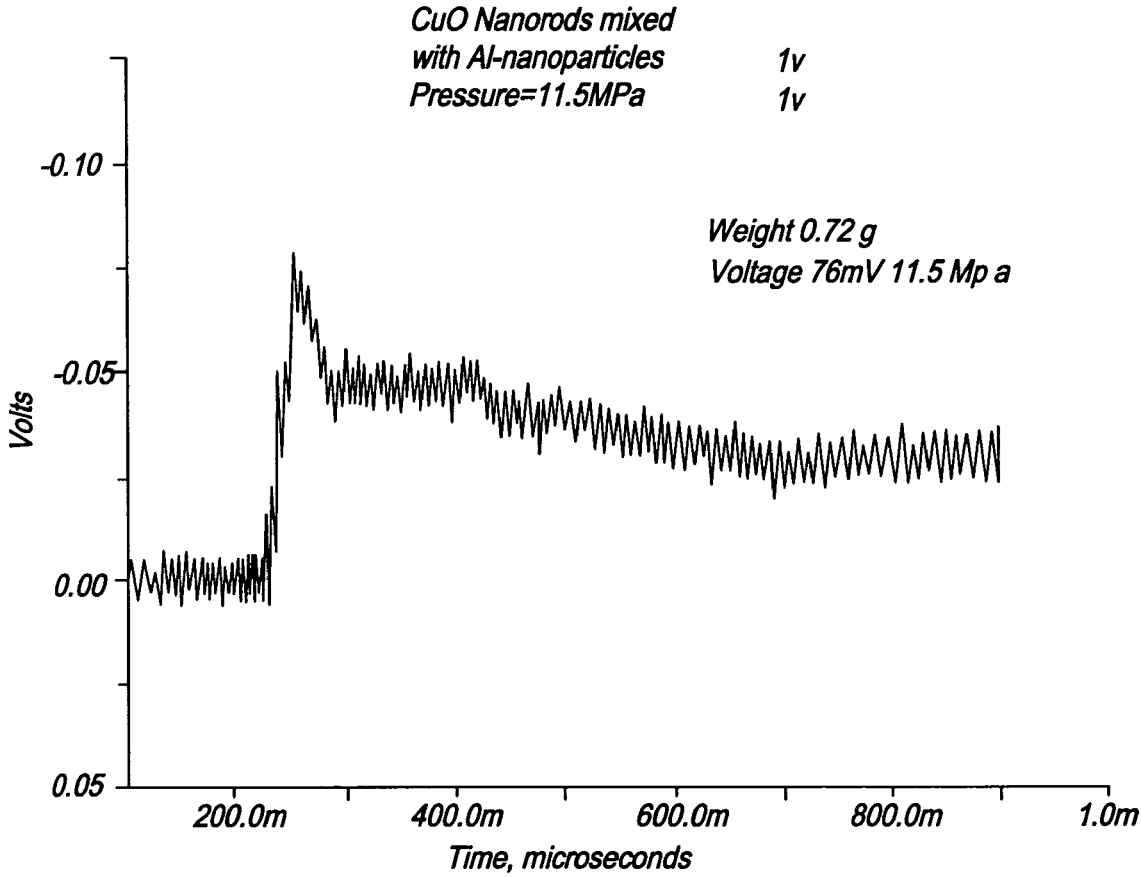
FIG. 5 is a graph of pressure over time during combustion of the nanoenergetic material.
Figure 6:
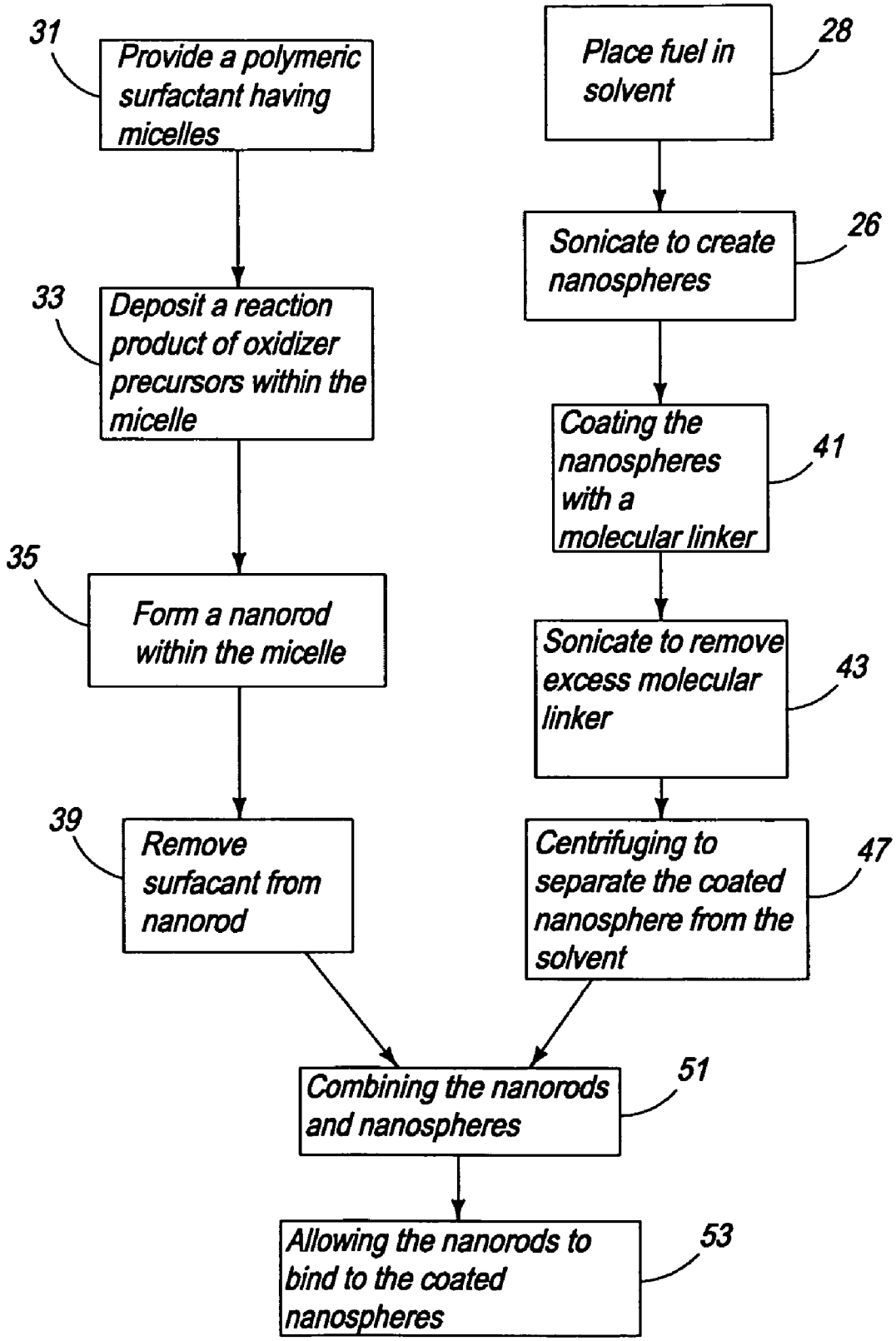
FIG. 6 is a block diagram of the process for making nanoenergetic materials having nanorods.
Figure 7:
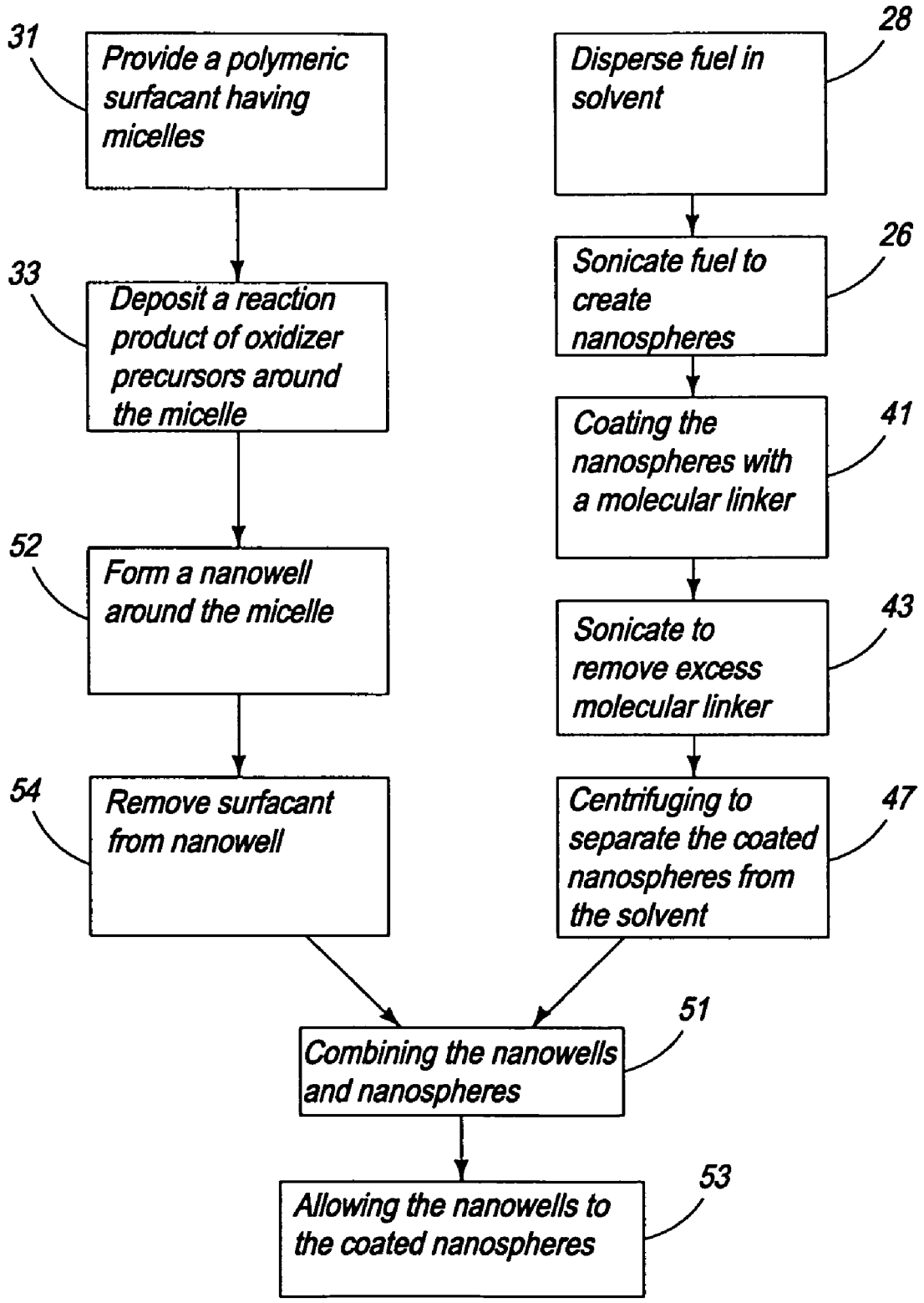
FIG. 7 is a block diagram of the process for making nanoenergetic materials from nanowells.

We have observed that the burn rate for $Fe_2O_3$/Al combination is significantly less compared to $CuO_2$/Al. The addition of nano-ammonium nitrate 50 to the iron oxide thermite increases the pressure and burn rate velocity due to gas generation. With the choice of a nanocomposite 10 of CuO/Al and nano-ammonium nitrate 50, the properties of the combined material can be tuned to achieve a green primer. However, the nanoenergetic material 10 has the properties of a propellant by replacing CuO by $Fe_2O_3$. FIG. 5 shows the graph of pressure over time, confirming formation of the shock wave.

Burn rates exceeding the speed of sound are attainable using the nanoenergetic materials of this invention. Table 1 shows the burn rates of copper oxide and aluminum, where the materials differ only in configuration and copper oxide and aluminum added with polymer and explosive nanoparticles. As shown in this table, the copper oxide nanorods self-assembled with aluminum nanoparticles and the copper oxide nanowells impregnated with aluminum nanoparticles have the highest burn rates.

TABLE I

| Serial number | Composite | Burn rate, m/s |
|---|---|---|
| 1 | Copper oxide (CuO) nanowells impregnated with Aluminum (Al)-nanoparticles | 2100–2400 |
| 2 | CuO nanorods mixed with Al-nanoparticles | 1500–1800 |
| 3 | CuO nanorods self-assembled with Al-nanoparticles | 1800–2200 |
| 4 | CuO nanorods mixed with 10% ammonium nitrate and Al-nanoparticles | 1900–2100 |
| 5 | CuO nanowire mixed with Al-nanoparticles | 1900 |
| 6 | CuO nanoparticles mixed with Al-nanoparticles | 550–780 |
| 7 | CuO nanorods mixed with Al-nanoparticles and 0.1% poly(4-vinyl pyridine) | 1800–1900 |
| 8 | CuO nanorods mixed with Al-nanoparticles and 0.5% poly(4-vinyl pyridine) | 1400–1500 |
| 9 | CuO nanorods mixed with Al-nanoparticles and 2% poly(4-vinyl pyridine) | 900–1200 |
| 10 | CuO nanorods mixed with Al-nanoparticles and 5% poly(4-vinyl pyridine) | 400–600 |

Many uses are contemplated for the nanoenergetic materials described here. They may be used in applications where it is useful to generate a shock wave that is not pressure based. Such an application is in the medical field, where shock waves without detonation are used to crush stones in the kidney or gall bladder without the need for an invasive surgical procedure. Nanoenergetic materials are also useful as explosives, as detonators and other munitions applications. Because the nanoenergetic material burns so quickly, the heat from the flame can be dissipated rapidly. Thus, the nanoenergetic materials are useful in the vicinity of some materials or with some substrates without sustaining heat damage.

A particularly advantageous way of utilizing the nanoenergetic materials 10 disclosed herein is described in copending U.S. Ser. No. 11/261,831, entitled, "On-Chip Igniter and Method of Manufacture," previously incorporated by reference. The nanoenergetic material is patterned onto a chip having an igniter and a detector. An electrical impulse heats the igniter, initiating combustion of the nanoenergetic material 10. When configured on the chip, the nanoenergetic material 10 is useful as an igniter for combustible materials, a detonator, a heat or power source or any apparatus that produces heat or a sonic shock wave.

Example 1

Synthesis of Copper Oxide Nanorods

For the synthesis of 5.045 g of copper chloride dihydrate ($CuCl_2.2\,H_2O$, 99.5% Sigma Aldrich) was pulverized to a fine powder by grinding it in a mortar with a pestle. The finely powdered $CuCl_2.2H_2O$ and 3.0 g NaOH were mixed together and 6.0 ml of PEG 400 (Polyethylene glycol 400, Alfa Aesar) was added into the mixture. This mixture was vigorously pulverized in a mortar for 45 minutes. During grinding, the copper chloride and sodium hydroxide were forced into the micelles of the PEG 400. The $CuCl_2$ and NaOH then reacted to form CuO nanorods inside the micelles. The PEG 400 coating was removed by washing with water and ethanol.

Example 2

Synthesis of Coated Aluminum Nanospheres

Aluminum nanoparticles were made by sonicating 0.42 g of aluminum in 300 ml of 2-propanol for 5 hours to achieve homogenous dispersion. To this solution, 1 ml of 0.1% solution of poly (4-vinylpyridine) in 2-propanol was added and the resultant solution was sonicated for an additional 2 hours. This solution was centrifuged until a clear supernatant was obtained. The solid recovered from the centrifuge was added to fresh 2-propanol, and the process of sonication followed by centrifugation was repeated 4-5 times to remove excess polymer. The coating that remained on the nanoparticles was substantially a monolayer.

Example 3

Self-Assembly of Nanoenergetics

One gram of copper oxide nanorods was sonicated in 200 ml of 2-propanol for 4 hours. The well-dispersed aluminum nanoparticles were then added into the nanorod dispersion. After sonicating for 3 hours, the final solution was dried at 120° C. to obtain the self-assembled nanocomposite.

Example 4

Burn Rate Testing

The burn rate of the energetic material was evaluated using a Tektronix TDS460A 4-channel digital oscilloscope. For each experiment, a Lexan tube with 0.8 $cm^3$ volume was filled up with energetic material and inserted into an aluminum block instrumented with fiber optic photo detectors and piezo-crystal pressure sensors to facilitate the burn rate and pressure measurement. The two pressure sensors (PCB 112A22) were installed at 2 cm spacing on one side of the block and optical fibers (Thorlabs M21L01) leading to photodetectors (Thorlabs DET210) on the other side of the block at 1 cm interval. Each tube has two pre-drilled 1 mm ports in the tubing wall, which were aligned with the pressure sensors. As energetic reaction triggers, oscilloscope records voltage signal with respect to time for photo detectors and pressure sensors. The burn rate of energetic material was determined based on the rise time of signal for the two photo detectors and pressure was evaluated using voltage response of pressure sensors that multiplied by the standard conversion factor. The results of burn rate testing are as follows:

TABLE 2

| Oxidizer | Shape | Fuel | Shape | Burn Rate |
|---|---|---|---|---|
| CuO | Nanowell | Al | Nanoparticles | 2400 m/s |
| CuO | Nanorods (no assembly) | Al | Nanoparticles | 1480 m/s |
| CuO | Nanorods (self-assembled) | Al | Nanoparticles | 2170 m/s |
| CuO | Nanorods | Al | Nanoparticles | 2110 m/s |
| $Fe_2O_3$ | Aerogel | Al | Nanoparticles | 970 m/s |
| CuO | Nanoparticles | Al | Nanoparticles | 630 m/s |
| $Bi_2O_3$ | Nanoparticles | Al | Nanoparticles | 340 m/s |
| $MoO_3$ | Nanoparticles | Al | Nanoparticles | 171 m/s |
| $WO_3$ | Nanoparticles | Al | Nanoparticles | 60 m/s |

Example 5

Explosive nanoparticles were prepared by dissolving 25 gm of ammonium nitrate in 2-methoxyethanol to make 100 ml solution (25% weight/volume). The solution was then kept under vigorous stirring at 60° C. for 4 hours. To this solution, 2-propanol was added as approximately 100 ml/min, under vigorous stirring. The suspension was thoroughly washed with either ethanol or 2-propanol to remove 2-methoxy ethanol. The sediment was separated by centrifugation at 2500 rpm for 10 minutes. The sediment was heated at 120° C. in order to obtain ammonium nitrate nanoparticles. This process is also useful to obtain nanoparticles of traditional explosives or propellants.

Example 6

Nanoenergetic material including $Fe_2O_3$/Al and nanoammonium nitrate was prepared. To 10 ml of a solution containing 1 g of ammonium nitrate in 2-methoxyethanol, 0.3 g of iron oxide gel was added. The mixture was kept under vigorous stirring with a magnetic stirrer for 4 hours. The suspension was washed thoroughly with 2-propanol to remove excess ammonium nitrate from iron oxide. The sediment separated by centrifugation at 2500 rpm for 10 minutes was then dried in oven at 120° C. for 2 hours. Ammonium nitrate infiltrated iron oxide was mixed with aluminum nanoparticles to prepare a nanocomposite.

While particular embodiments of the nanoenergetic composites have been shown and described, it will be appreciated by those skilled in the art that changes and modifications may be made thereto without departing from the invention in its broader aspects and as set forth in the following claims.

What is claimed is:

1. A structured, self-assembling nanoenergetic composition comprising:

a nanostructure comprising at least one of the group consisting of a fuel and an oxidizer, wherein said nanostructure comprises one selected from the group consisting of a nanorod and a nanowell;

a plurality of substantially spherical nanoparticles comprising at least the other of the group consisting of a fuel and an oxidizer; and a monolayer of a molecular linker having two bonding sites wherein one of said two bonding sites is bonded to one of said nanostructure and the second of said two bonding sites is bonded to said spherical nanoparticles, wherein said spherical nanoparticles are arranged around a surface of said nanostructure.

2. The self-assembling nanoenergetic composition of claim 1 wherein an equivalence ratio of the fuel to the oxidizer is about 1.4 to about 1.8.

3. The self-assembling nanoenergetic composition of claim 1 wherein said nanostructure comprises said oxidizer.

4. The self-assembling nanoenergetic composition of claim 1 wherein said oxidizer comprises at least one of the group comprising copper oxide, silver oxide, bismuth oxide, cobalt oxide, chromium oxide, iron oxide, mercuric oxide, iodine oxide, manganese oxide, molybdenum oxide, niobium oxide, nickel oxide, lead oxide, palladium oxide, silicon oxide, tin oxide, tantalum oxide, titanium dioxide, uranium oxide, vanadium oxide and tungsten oxide.

5. The self-assembling nanoenergetic composition of claim 3 wherein said oxidizer comprises copper oxide.

6. The self-assembling nanoenergetic composition of claim 1 wherein said fuel comprises at least one of aluminum, boron, beryllium, hafnium, lanthanum, lithium, magnesium, neodymium, tantalum, thorium, titanium, yttrium and zirconium.

7. The self-assembling nanoenergetic composition of claim 5 wherein said fuel comprises aluminum.

8. The self-assembling nanoenergetic composition of claim 1 wherein said molecular linker comprises a polymer having at least two binding sites.

9. The self-assembling nanoenergetic composition of claim 1 wherein said molecular linker comprises at least one of the group consisting of polyvinyl pyrrolidone, poly(4-vinyl pyridine), poly(2-vinyl pyridine), poly(ethylene imine), carboxylated poly(ethylene imine), cationic poly(ethylene glycol) grafted copolymers, polyamide; polyether block amide, poly(acrylic acid), cross-linked polystyrene, poly(vinyl alcohol), poly(n-isopropylacrylamide), copolymer of n-acryloxysuccinimide, poly(acrylontrile), fluorinated polyacrylate, poly(acrylamide), polystyrene-poly(4-vinyl)pyridine and polyisoprene-poly(4-vinyl)pyridine.

10. The self-assembling nanoenergetic composition of claim 1 wherein said nanorod comprises copper oxide and said nanoparticle is aluminum.

11. The self-assembling nanoenergetic composition of claim 1 combined in a physical mixture with nano-ammonium nitrate.

12. The self-assembling nanoenergetic composition of claim 1 wherein said fuel comprises a metal.

13. The self-assembling nanoenergetic composition of claim 1 wherein said fuel has a higher free energy for oxide formation than said oxidizer.

14. The self-assembling nanoenergetic composition of claim 1 wherein said nanoenergetic composition has a burn rate of at least 1800 meters/sec.

15. The self-assembling nanoenergetic composition of claim 1 wherein said nanostructure is a nanorod.

16. The self-assembling nanoenergetic composition of claim 1 wherein said structure is a metastable intermolecular composite having a propagation velocity higher than a velocity of sound in the nanoenergetic composition.

17. The self-assembling nanoenergetic composition of claim 1 wherein said composition is a metastable intermolecular composite configured to produce a shock wave without a detonation.

18. The self-assembling nanoenergetic composition of claim 16 wherein said metastable intermolecular composite comprises one or more additional polymers to produce a tunable pressure and propagation velocity.

19. The self-assembled nanoenergetic composition of claim 1 wherein said nanoparticles comprise ammonium nitrate and a coating of copper oxide, wherein the coating of copper oxide is formed on said ammonium nitrate nanoparticles.

20. The self-assembled nanoenergetic composition of claim 15 wherein said nanorod is copper oxide and said nanoparticle is aluminium.

21. The self-assembled nanoenergetic composition of claim 15 wherein said nanorod is a nanowire.

* * * * *

UNITED STATES PATENT AND TRADEMARK OFFICE

CERTIFICATE OF CORRECTION

PATENT NO. : 7,927,437 B2
APPLICATION NO. : 11/262227
DATED : April 19, 2011
INVENTOR(S) : Gangopadhyay et al.

It is certified that error appears in the above-identified patent and that said Letters Patent is hereby corrected as shown below:

On the Title Page,

Page 2, 2nd Col. line 6 — Please delete "Compustion" and insert --Combustion-- in its place.

Page 2, 2nd Col. line 11 — Please delete "Syntheis" and insert --synthesis-- in its place.

Page 2, 2nd Col. line 18 — Please delete "Paramters" and insert --Parameters-- in its place.

Page 2, Item (56)
Under "Other Publications" — Please insert the following reference: --Hardwick, Neil T., "Controlling ESD Though Polymer Technology", www.schaffner.com.--.

Page 2, Item (56)
Under "Other Publications" — Please insert the following reference: --Miziolek, Andrzej W.; "Nanoenergetics: An Emerging Technology Area of National Importance", Amptiac Quarterly, Vol. 6, No. 1, pp. 43-48 and 67.--.

Col. 4, line 58 Please delete "35" and insert --35-- in its place.

Col. 6, line 8 Please delete "14" and insert --14-- in its place.

Col. 6, line 23 Please delete "51" and insert --51-- in its place.

Col. 9, line 18 Please delete "CuCl2.2 H2O)" and insert --CuCl2·2H2O-- in its place.

Col. 9, line 20 Please delete "CuCl2.2 H2O)" and insert --CuCl2·2H2O-- in its place.

Signed and Sealed this
Sixteenth Day of August, 2011

David J. Kappos

David J. Kappos
*Director of the United States Patent and Trademark Office*